US011761289B2

(12) United States Patent
Brandsdal

(10) Patent No.: US 11,761,289 B2
(45) Date of Patent: Sep. 19, 2023

(54) SHEARABLE SLEEVE

(71) Applicant: Nine Downhole Technologies, LLC, Houston, TX (US)

(72) Inventor: Viggo Brandsdal, Ytre Arna (NO)

(73) Assignee: Nine Downhole Technologies, LLC, Houston, TX (US)

( * ) Notice: Subject to any disclaimer, the term of this patent is extended or adjusted under 35 U.S.C. 154(b) by 30 days.

(21) Appl. No.: 17/233,215

(22) Filed: Apr. 16, 2021

(65) Prior Publication Data

US 2021/0340836 A1 Nov. 4, 2021

(30) Foreign Application Priority Data

May 4, 2020 (NO) ..... 20200520

(51) Int. Cl.
*E21B 33/12* (2006.01)
*E21B 33/128* (2006.01)
*E21B 34/06* (2006.01)

(52) U.S. Cl.
CPC ..... *E21B 33/1208* (2013.01); *E21B 33/128* (2013.01); *E21B 34/063* (2013.01); *E21B 2200/05* (2020.05)

(58) Field of Classification Search
CPC .... E21B 33/1208; E21B 33/12; E21B 34/063; E21B 2200/05
See application file for complete search history.

(56) References Cited

U.S. PATENT DOCUMENTS

| | | | |
|---|---|---|---|
| 1,884,165 | A | 10/1932 | Otis |
| 2,565,731 | A | 4/1951 | Johnston |
| 2,756,828 | A | 7/1954 | Deily |
| 3,599,713 | A | 8/1971 | Jenkins |
| 3,831,680 | A | 8/1974 | Edwards et al. |

(Continued)

FOREIGN PATENT DOCUMENTS

| | | | |
|---|---|---|---|
| CA | 2469251 | A1 | 7/2003 |
| CA | 2670218 | A1 | 12/2010 |

(Continued)

OTHER PUBLICATIONS

Frank Allen, et al., Extended-Reach Drilling: Breaking the 10-km Barrier (BP Exploration Operation Co. Ltd. 1997) at 46-47.

(Continued)

*Primary Examiner* — Theodore N Yao
(74) *Attorney, Agent, or Firm* — Vinson & Elkins L.L.P.

(57) ABSTRACT

A shearable sleeve supports a disintegrable plug element in a pipe string, and may include a first portion including a first circumferential end surface, a seat for supporting the disintegrable plug element, a second portion including a second circumferential end surface, and a surface extending axially between the first and second circumferential end surfaces and formed with one or more radial protrusions adapted to shear off from the rest of the sleeve when being exposed to a predefined axial force, and one or more recesses for receiving one or more loading devices for initiating disintegration of the disintegrable plug element upon contact with the plug, wherein one or more radial protrusions is/are axially offset relative to the first circumferential end surface. A plug device, as well as a plug assembly in a pipe string, may include the shearable sleeve.

26 Claims, 11 Drawing Sheets

(56) References Cited

U.S. PATENT DOCUMENTS

| | | | | |
|---|---|---|---|---|
| 4,512,491 | A | 4/1985 | DeGood et al. | |
| 4,553,559 | A | 11/1985 | Short | |
| 4,658,902 | A | 4/1987 | Wesson et al. | |
| 4,664,184 | A | 5/1987 | Grigar | |
| 4,691,775 | A | 9/1987 | Lustig et al. | |
| 4,813,481 | A | 3/1989 | Sproul et al. | |
| 5,050,630 | A | 9/1991 | Farwell et al. | |
| 5,117,915 | A | 6/1992 | Mueller et al. | |
| 5,188,182 | A | 2/1993 | Echols et al. | |
| 5,479,986 | A * | 1/1996 | Gano | E21B 23/04 166/292 |
| 5,511,617 | A | 4/1996 | Snider et al. | |
| 5,685,372 | A | 11/1997 | Gano | |
| 5,829,526 | A | 11/1998 | Rogers et al. | |
| 5,924,696 | A | 7/1999 | Frazier | |
| 5,996,696 | A | 12/1999 | Jeffree et al. | |
| 6,334,488 | B1 | 1/2002 | Freiheit | |
| 6,397,950 | B1 | 6/2002 | Streich et al. | |
| 6,472,068 | B1 | 10/2002 | Glass et al. | |
| 6,561,275 | B2 | 5/2003 | Glass et al. | |
| 6,634,430 | B2 | 10/2003 | Dawson et al. | |
| 6,672,389 | B1 | 1/2004 | Hinrichs | |
| 7,117,946 | B2 | 10/2006 | Herr | |
| 7,287,596 | B2 | 10/2007 | Frazier et al. | |
| 7,455,116 | B2 | 11/2008 | Lembcke et al. | |
| 7,513,311 | B2 | 4/2009 | Gramstad et al. | |
| 7,624,796 | B2 | 12/2009 | Hassel-Sorensen | |
| 7,661,480 | B2 | 2/2010 | Al-Anazi | |
| 7,673,689 | B2 | 3/2010 | Jackson et al. | |
| 7,708,066 | B2 | 5/2010 | Frazier | |
| 7,789,162 | B2 | 9/2010 | Keller et al. | |
| 7,950,409 | B2 | 5/2011 | Stokes et al. | |
| 7,963,340 | B2 | 6/2011 | Gramstad et al. | |
| 7,963,342 | B2 | 6/2011 | George | |
| 8,813,848 | B2 | 8/2014 | Frazier | |
| 8,820,437 | B2 | 9/2014 | Ervin et al. | |
| 9,194,209 | B2 | 11/2015 | Frazier | |
| 9,624,750 | B2 | 4/2017 | Entchev et al. | |
| 2003/0168214 | A1 | 9/2003 | Sollesnes | |
| 2007/0012438 | A1* | 1/2007 | Hassel-Sorensen | E21B 33/1208 166/250.08 |
| 2009/0020290 | A1 | 1/2009 | Ross et al. | |
| 2009/0056955 | A1 | 3/2009 | Slack | |
| 2014/0008085 | A1 | 1/2014 | Tinnen | |
| 2016/0060998 | A1* | 3/2016 | Hiorth | E21B 34/063 166/192 |
| 2017/0022783 | A1* | 1/2017 | Yong | H04L 67/42 |
| 2018/0245421 | A1* | 8/2018 | Brandsdal | E21B 29/00 |
| 2019/0017345 | A1 | 1/2019 | Brandsdal | |

FOREIGN PATENT DOCUMENTS

| | | | |
|---|---|---|---|
| WO | 1991012451 | A1 | 8/1991 |
| WO | 2003052239 | A1 | 6/2003 |
| WO | 2009116871 | A1 | 9/2009 |

OTHER PUBLICATIONS

Oil and Gas Online, Single MagnumDisk™ (Jun. 21, 2011).

Owen Oil Tools, Magnum Ported Underbalance Sub (Core Lab Sep. 2012), at 1-2.

Owen Oil Tools, Surge Tool, Underbalance Sub (Core Lab Jun. 2002), at 1-3.

Rogers et al., Buoyancy Technology Used Effectively in Casing Running Operations to Extend Lateral Stepout, SPE/IADC 148541 (Oct. 24, 2011), at 2-3, 11; Fig 13.

Shaker et al., Implementation of New Technologies for Oil and Gas Industry, SPE 88738 (Oct. 2004), at 1, 3, 5-6.

Farrar, Chilien M., U.S. Pat. No. 244,042 entitled "Check for Oil Well Tubes," dated Jul. 12, 1881.

* cited by examiner

SHEARABLE SLEEVE

CROSS REFERENCE TO RELATED APPLICATIONS

The application claims benefit of priority from Norwegian Patent Application No. 20200520, filed May 4, 2020, titled SHEARABLE SLEEVE, which is incorporated herein by reference in its entirety for all purposes.

BACKGROUND

Field of the Disclosure

The present disclosure relates to a shearable sleeve. More specifically the disclosure relates to a shearable sleeve for supporting a disintegrable plug element in a pipe string. The disclosure also relates to a plug device, as well as a plug assembly in a pipe string, including such a shearable sleeve.

Description of the Related Art

Disintegrable plugs, such as glass plugs and ceramic plugs, are known from the prior art. Disintegrable plugs are also known where disintegration of the plug element may be initiated by means of hydraulic pressure controlled from topside, which reduces the need for interventions runs into the well. A disadvantage of several of the known disintegrable plugs is that residues from the plug element itself or from plugs seats, shearing devices, loading devices and or other parts of activation mechanisms may become loose and may enter the well stream, potentially damaging well equipment such as pumps or other components used in the circulation of well fluids after opening of the plug.

U.S. Patent Publication Number 2019/0017345 A1 discloses a disintegrable plug element resting on a shearable sleeve in a pipe string. In one of the disclosed embodiments, the plug elements may rest in a seat at the upper portion of the shearable sleeve, where a sealing element is sealing between the plug element and the surrounding pipe string. When the plug element is exposed to an increasing hydraulic pressure from above, the axial force exerted by the plug element on the seat portion of the shearable sleeve may increase. At a pre-defined axial force, radial protruding tabs of the shearable sleeve may shear off from the sleeve, whereby the plug element may be free to move axially downwardly in the pipe string together with a cylindrical "main" portion of the shearable sleeve. When being moved downwardly, the plug element may move into contact with a loading device in the form of one or more spikes/knives or similar. The forced contact with the spikes may initiate disintegration of the plug element by the creation of point loads in the plug element. By continued hydraulic pressure application, the plug element may then be crushed into very small pieces. One feature of this embodiment is that the radial protruding tabs may rest against an axial support surface in the pipe string. When the tabs are sheared off, the main portion of the shearable sleeve is displaced axially downwardly into the well, away from the tabs. When the plug element disintegrates, the tabs may have no radial support and may fall into the well. In another embodiment disclosed in the same application, another shearable sleeve is provided where the radial protruding tabs are provided at the lower and opposite end compared to the seat portion.

BRIEF SUMMARY

The advantages of the present disclosure may be achieved through features, which are specified in the description below and in the claims that follow.

The disclosure generally relates to a shearable sleeve for supporting a disintegrable plug element in a pipe string. The disintegrable plug element may be made fully or partially from glass, ceramic, a vitrified material or any other material suitable for use as a disintegrable plug element in a downhole well.

In a first aspect, a shearable sleeve for supporting a disintegrable plug element in a pipe string is disclosed. The shearable sleeve may include a first portion including a first circumferential end surface, a seat for supporting the disintegrable plug element, the seat being included in the first portion of the shearable sleeve, and a second portion including a second circumferential end surface. The shearable sleeve may further include a third surface extending axially between the first circumferential end surface and the second circumferential end surface. In the shearable sleeve, the third surface may include a radial protrusion adapted to shear off from the rest of the sleeve when exposed to a predefined axial force and a recess for receiving a loading device for initiating disintegration of the disintegrable plug element. The shearable sleeve may be characterized in that the radial protrusion is axially offset relative to the first circumferential end surface.

In any of the disclosed embodiments of the shearable sleeve, the radial protrusion may be axially offset from the second circumferential end surface.

In any of the disclosed embodiments of the shearable sleeve, the radial protrusion may be located substantially half-way between the first circumferential end surface and the second circumferential end surface.

In any of the disclosed embodiments of the shearable sleeve, in a position of use in a pipe string, the first portion may be an upper portion of the shearable sleeve and the second portion may be a lower portion of the shearable sleeve.

In any of the disclosed embodiments of the shearable sleeve, the shearable sleeve may be used as a pre-assembled part.

In any of the disclosed embodiments of the shearable sleeve, the first portion with the seat may be a lower portion, whereby the plug element may be placed inside the outer surface portion of the shearable sleeve before activation.

The third surface extending between the circumferential end surfaces may, except from the mentioned protrusions and recesses, be substantially cylindrical. However, in various embodiments the third surface may be slightly conical.

In any of the disclosed embodiments of the shearable sleeve, the shearable sleeve may be provided and used as a unitary part, such as a pre-assembled assembly of parts, which may significantly simplify construction and reliability of use. The shearable sleeve may be made from a metal alloy such as aluminium bronze, nickel bronze or nickel aluminium bronze.

In a second aspect, a plug device for insertion into a pipe string is disclosed. The plug device may include a shearable sleeve, a disintegrable plug element adapted to be supported by a seat, a loading device adapted to be received in a recess of the shearable sleeve and adapted to initiate disintegration of the disintegrable plug element upon contact with the disintegrable plug, and a sealing device for sealing the disintegrable plug element with the pipe string. In the plug device, the shearable sleeve may include a first portion including a first circumferential end surface, the seat for supporting the disintegrable plug element, the seat being included in the first portion of the shearable sleeve, and a second portion including a second circumferential end surface. In the plug device, the shearable sleeve may further include a third surface extending axially between the first circumferential end surface and the second circumferential end surface. In the plug device, the third surface may include a radial protrusion adapted to shear off from the rest of the sleeve when exposed to a predefined axial force and a recess for receiving a loading device for initiating disintegration of the disintegrable plug element. In the plug device, the shearable sleeve may be characterized in that the radial protrusion is axially offset relative to the first circumferential end surface.

In any of the disclosed embodiments, the plug device may further include a support ring for supporting the disintegrable plug element.

In any of the disclosed embodiments, the plug device may further include an abutment member adapted to support the radial protrusion against the pipe string.

In any of the disclosed embodiments of the plug device, the shearable sleeve, the disintegrable plug element, and the loading device may be enabled for assembly by an end user of the plug device.

In any of the disclosed embodiments, the plug device may further include an insert member formed as a cylindrical housing for the disintegrable plug element.

In any of the disclosed embodiments of the plug device, the shearable sleeve, the disintegrable plug element, the sealing device and the insert member may be enabled for pre-assembly.

In any of the disclosed embodiments of the plug device, the plug device may be axially movable together with the main portion of the shearable sleeve after the radial protrusions have been sheared off.

In a third aspect, a plug assembly is disclosed. The plug assembly may include a plug device and a plug housing in which the plug device is located. In the plug assembly, the plug device may include a shearable sleeve, a loading device, and a sealing device. In the plug assembly, the loading device may be adapted to be received in the recess of the shearable sleeve and adapted to initiate disintegration of a disintegrable plug element upon contact with the disintegrable plug. In the plug assembly, the sealing device is for sealing the disintegrable plug element with the pipe string. In the plug assembly, the disintegrable plug element may be movable in an axial direction of the pipe string between a first position in which the disintegrable plug element is spaced apart from the loading device and a second position in which the disintegrable plug element is in contact with the loading device.

In the plug assembly, the shearable sleeve may include a first portion including a first circumferential end surface, the seat for supporting the disintegrable plug element, the seat being included in the first portion of the shearable sleeve, and a second portion including a second circumferential end surface. In the plug assembly, the shearable sleeve may further include a third surface extending axially between the first circumferential end surface and the second circumferential end surface. In the plug assembly, the third surface may include a radial protrusion adapted to shear off from the rest of the sleeve when exposed to a predefined axial force and a recess for receiving a loading device for initiating disintegration of the disintegrable plug element. In the plug assembly, the shearable sleeve may be characterized in that the radial protrusion is axially offset relative to the first circumferential end surface.

BRIEF DESCRIPTION OF THE DRAWINGS

For a more complete understanding of the present disclosure and its features and advantages, reference is now made to the following description, taken in conjunction with the accompanying drawings, in which.

DETAILED DESCRIPTION

Figure 1:
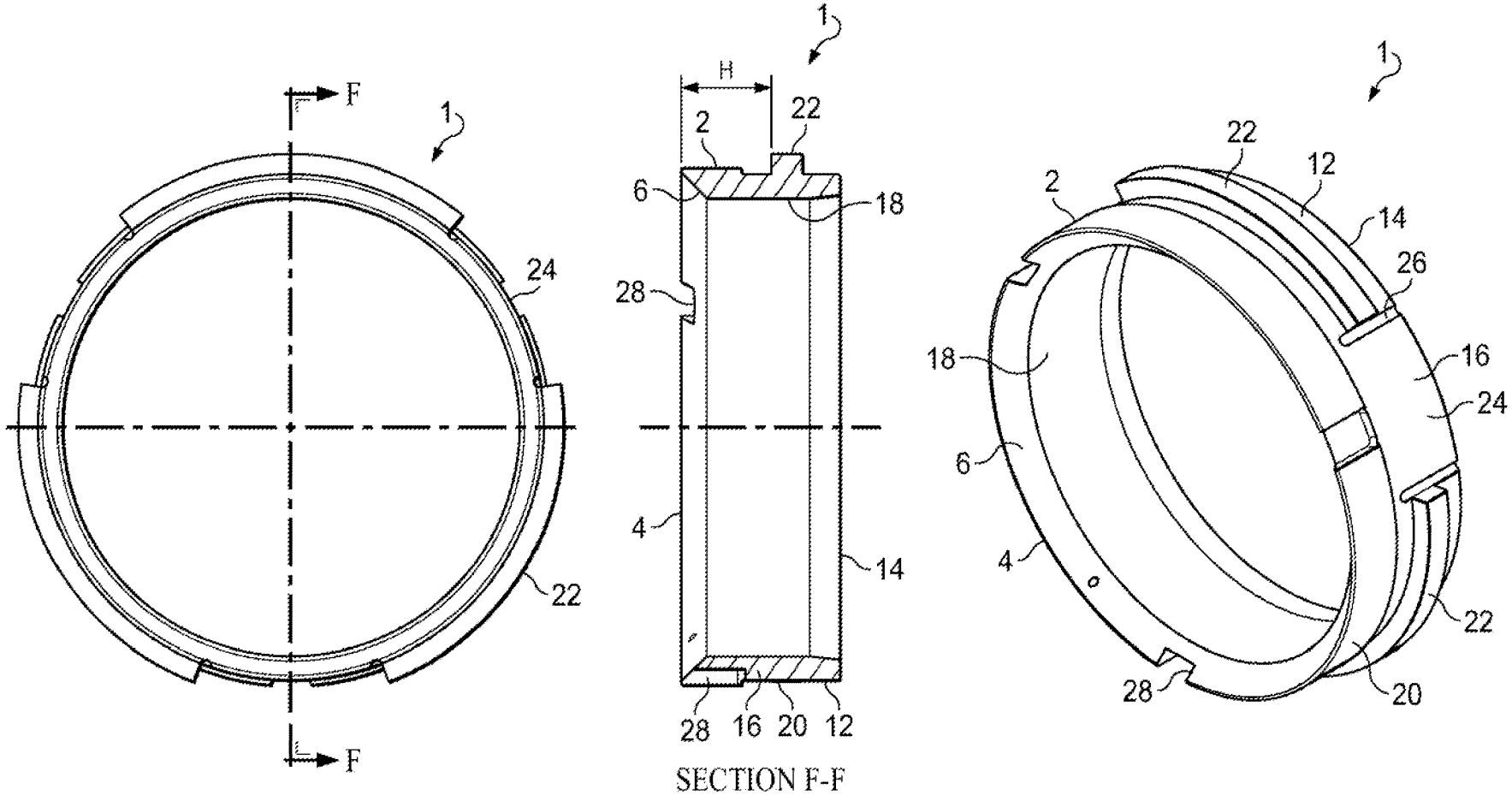
FIG. 1 depicts a first embodiment of a shearable sleeve.

In the following description, details are set forth by way of example to facilitate discussion of the disclosed subject matter. It should be apparent to a person of ordinary skill in the field, however, that the disclosed embodiments are exemplary and not exhaustive of all possible embodiments.

In the following, the reference numerals 1, 601 will be used to denote a shearable sleeve according to the first aspect of the disclosure, whereas reference numerals 10, 610 and 100, 800 will be used to denote a plug device and plug assembly, respectively, according to the second and third aspects of the disclosure.

Identical reference numerals are used to identify identical or similar features in the drawings. The drawings are shown schematically and various features therein are not necessarily drawn to scale or perspective.

Figure 2:
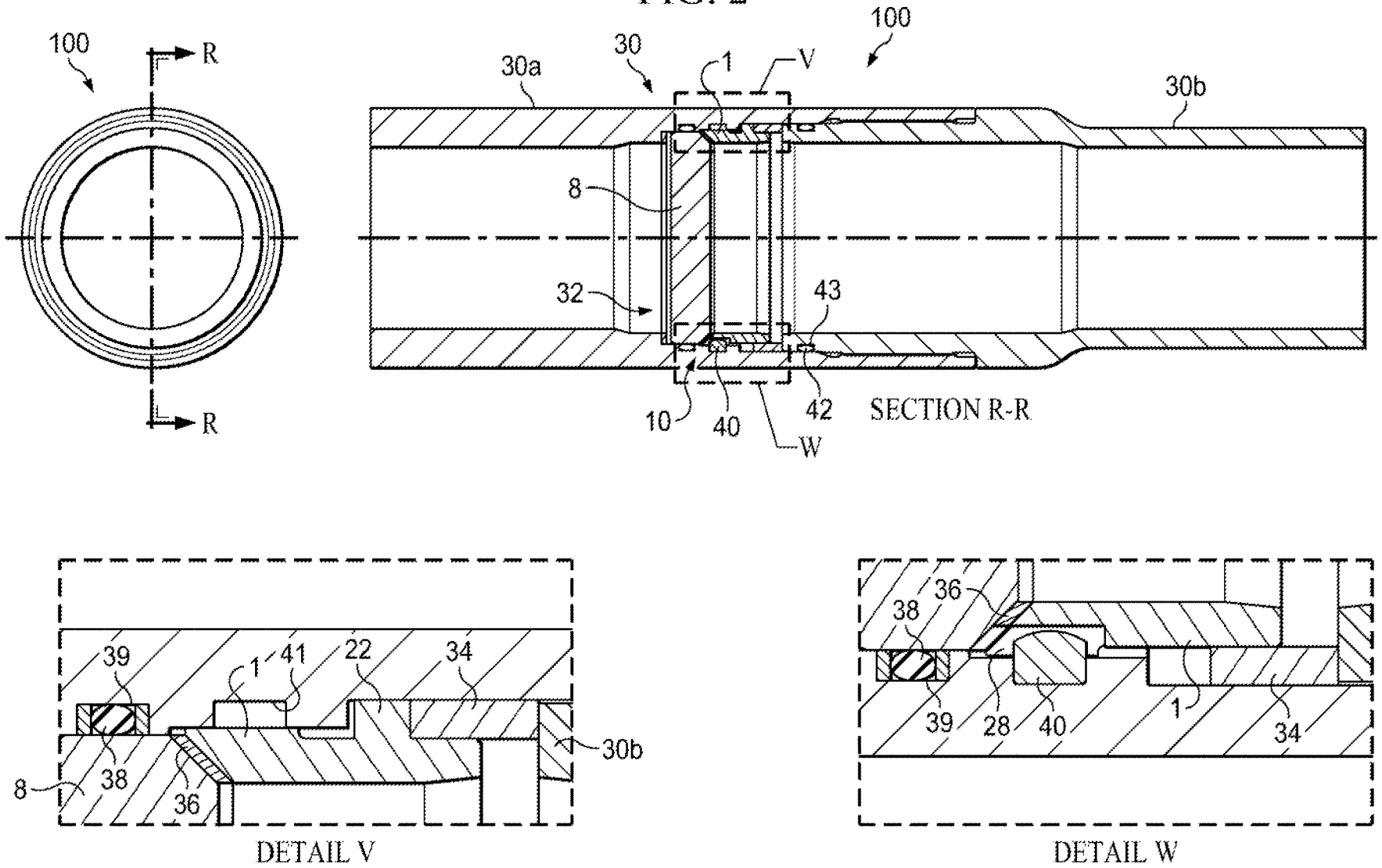
FIG. 2 depicts the first embodiment of the shearable sleeve in a position of use in a plug assembly.
Figure 3:
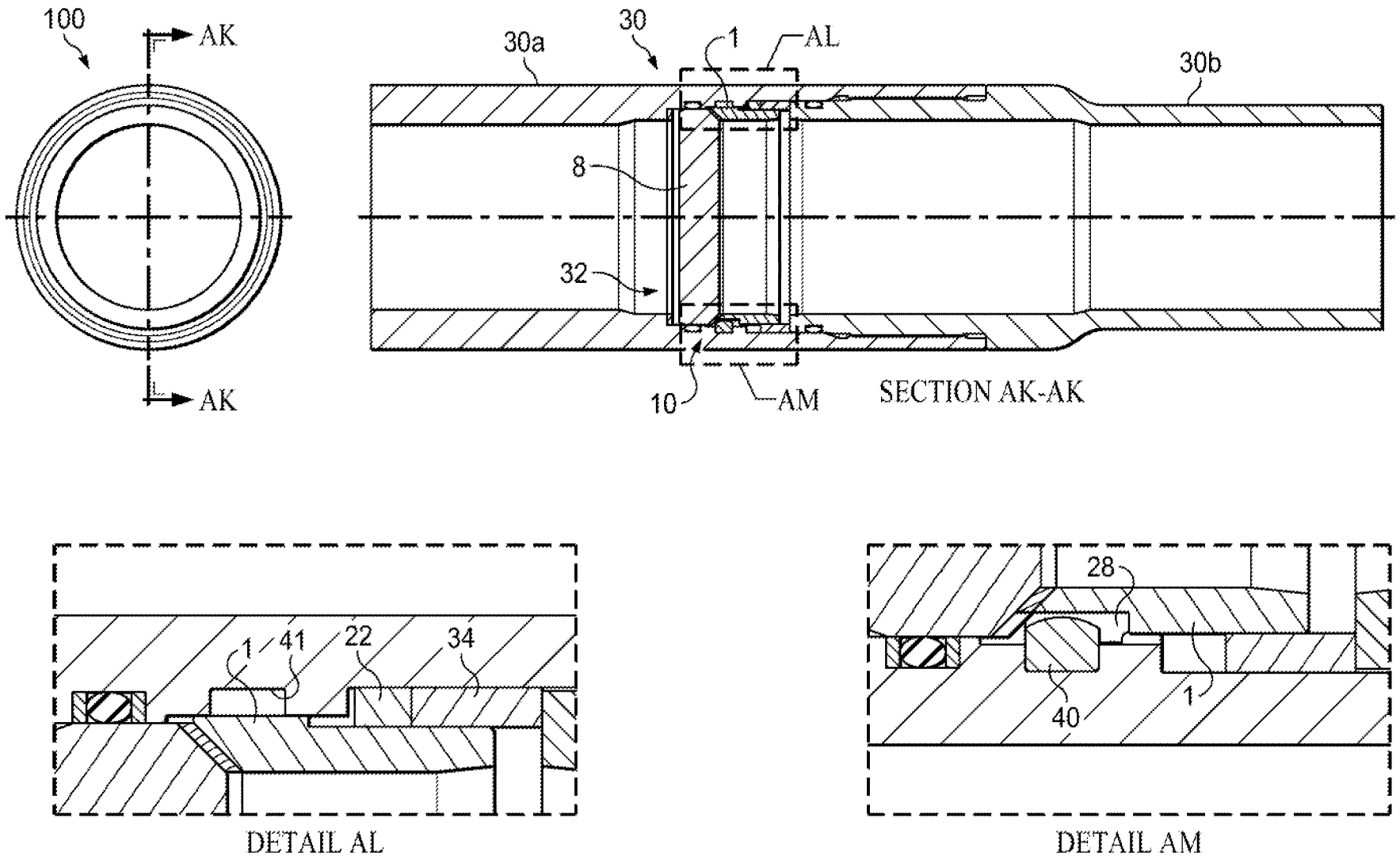
FIG. 3 depicts the first embodiment of the shearable sleeve in a position of use in a plug assembly.
Figure 4:
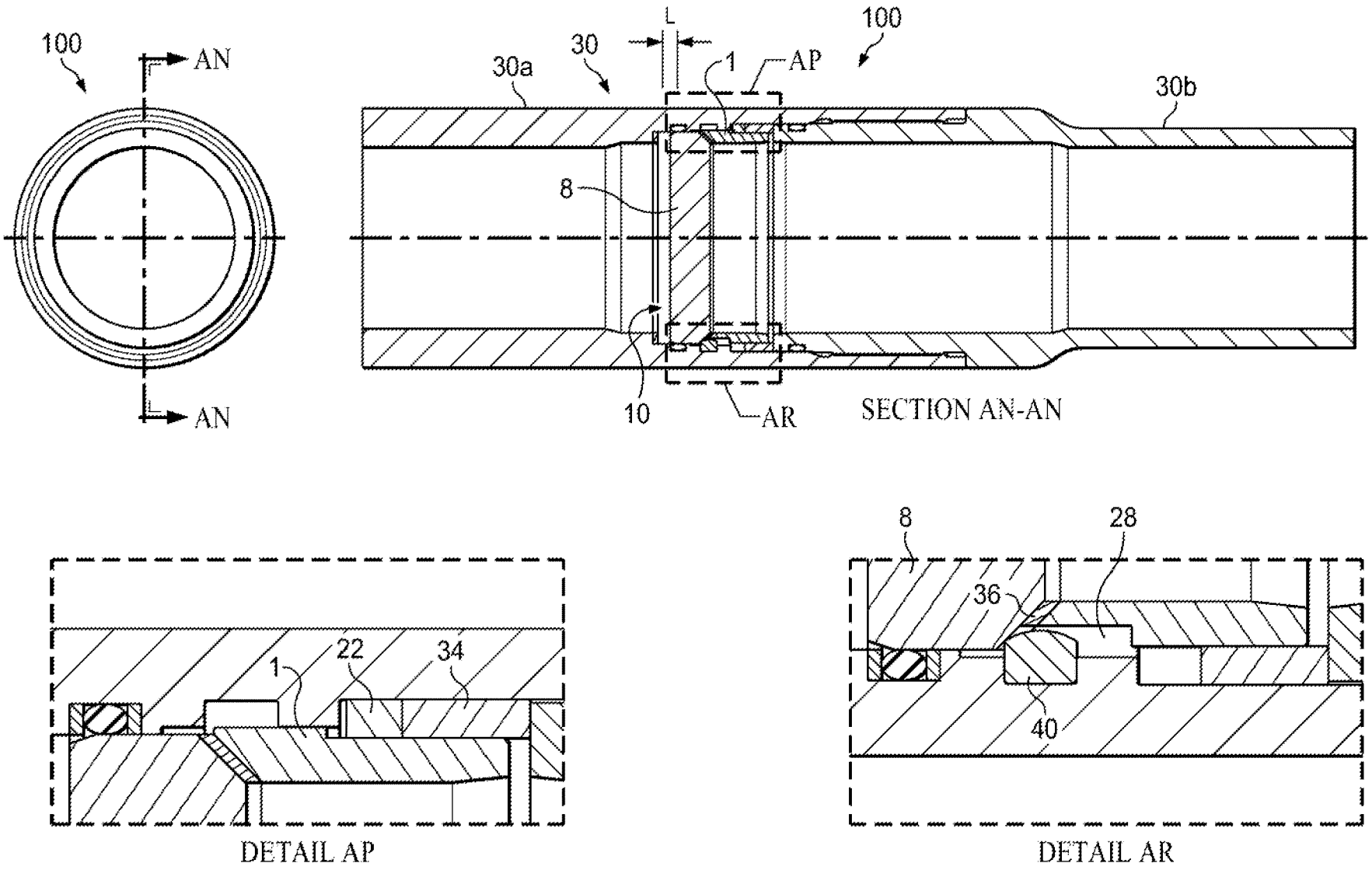
FIG. 4 depicts the first embodiment of the shearable sleeve in a position of use in a plug assembly.

In FIG. 1 a first embodiment of a shearable sleeve 1 is shown in a top view to the left, in a cross-sectional axial view in the middle, and in a perspective view to the right. The shearable sleeve 1, which is formed substantially cylindrically, has a first portion 2, including a first circumferential end surface 4. The first portion 2 includes a seat 6 adapted to support a disintegrable plug element 8 (as shown in FIGS. 2-4) in use. Opposite the first portion 2, the shearable sleeve 1 is provided with a second portion 12 including a second circumferential end surface 14. Between the first circumferential end surface 4 and the second circumferential end surface 14, a substantially cylinder-shaped surface 16 is shown extending.

In use of embodiment shown in FIG. 1, the first portion 2 may define an upper portion of the shearable sleeve 1, while the second portion 12 may define a lower portion. The cylinder surface 16 may have a substantially smooth inner portion 18. From an outer portion 20 of the cylinder surface 16, three protrusions 22 are shown extending radially outward and defining shearable parts of the shearable sleeve 1. In alternative embodiments (not shown), the number of protrusions 22 may be lower or higher. The circumferential length, axial thickness or other dimensions of the radial protrusions 22 may be varied to tailor the shear strength of the shearable sleeve to different activation pressures.

The shearable sleeve shown in FIG. 1 may be adapted to withstand pressures up to 10,000 psi before shearing. Depending on the shear rating of the shearable sleeve 1, the radial protrusions 22 may have an axial thickness of about 5 to about 15 millimeters.

As shown in FIG. 1, the one or more shearable, radial protrusions 22 at an axial distance from the plug seat may at least partially avoid an unfavourable load case/distribution. By also providing the one or more radial protrusions 22 with an axial offset from the second circumferential end surface 14, this positive effect on the load case may be even more pronounced. The axial distance from the first circumferential end surface 4, and potentially also the second, circumferential end surface 14, to the radial protrusions 22 may be about 5 millimeters or more, or about 10 millimeters or more. In a further embodiment, the radial protrusions 22 may be provided substantially half-way between the between the first circumferential end surface 4 and the second circumferential end surface 14. Providing the shearable protrusions/tabs 22 near an axial mid portion of the shearable sleeve 1 may be beneficial both for avoiding bending of the shearable sleeve 1 upon activation and for leaving the radial protrusions 22 radially supported (or "trapped") after activation/disintegration of the disintegrable plug element 8 so that the radial protrusions 22 do not fall into the pipe string.

In the embodiment shown in FIG. 1, each radial protrusion 22 may covers about 90° of the circumference of the outer cylinder surface 20, while each protrusion 22 may be separated by a 30° gap 24. In the transition between each protrusion 22 and each gap 24, the outer portion 20 of the sleeve 1 may be formed with a small, slim recess/scratch 26 extending axially from above each radial protrusion 22 to the lower circumferential surface 14. The scratches may contribute to a clearer shearing of the protrusions 22, and thereby, to a more reliable activation of the plug assembly. The shearable sleeve 1 may further be formed with one or more (shown here with three) recesses 28 adapted to house loading devices for initiating disintegration of the disintegrable plug element 8, as will become clearer with reference to the following drawings.

In the embodiment shown in FIG. 1, the three recesses 28 are distributed evenly around the first circumferential end surface 4 and extend about ⅖ of the axial length of the shearable sleeve 1 downwardly. The radial protrusions 22 are provided at a distance from both the first circumferential end surface 4 and the second circumferential end surface 14 of the shearable sleeve, such that the protrusions 22 are provided axially offset both from the seat 6 and from the lower, second portion 12 of the shearable sleeve 1. As explained above, this axial offset may improve the load distribution in the shearable sleeve 1 during activation, which may reduce the risk of the cylinder surface 16 bending, instead of the protrusions/tabs 22 shearing off as intended.

In the embodiment shown in FIG. 1, the protrusions 22 are provided substantially half-way between the first circumferential end surface 4 and the second circumferential end surface 14, and may be slightly nearer to the second circumferential end surface 14. This arrangement of the first circumferential end surface 4 and the second circumferential end surface 14 may provide the benefit that the radial protrusions 22 are "hidden" behind the rest of the shearable sleeve 1 after shearing, for example, between the rest of the shearable sleeve 1 and the pipe string 30, when the rest of the shearable sleeve 1 is displaced axially downwardly in the pipe string 30 by hydraulic pressure from above, as will be explained in the following.

The plug device 10 and the plug assembly 100 may be enabled to prevent the radial protrusions 22 from falling into the pipe string. For example, the axial displacement length (L as shown in FIG. 4) of the disintegrable plug element 8, together with the main portion of the shearable sleeve 1 after shearing, may be shorter than a length H (see FIGS. 1, 6) from the radial protrusion 22 to the first circumferential end surface 4. As a result, the radial protrusions 22 may remain locked behind the shearable sleeve 1 after disintegration of the disintegrable plug element 8 and may be prevented from falling into the pipe string. The shearable sleeve 1 is, in the embodiment shown in FIG. 1, provided as one solid piece of material, such as made from an aluminium brass nickel alloy.

FIG. 2 shows, at the upper left, a top view of a plug assembly 100 according to the third aspect of the disclosure. In FIG. 2, an axial cross-section R-R is shown at the upper right, while enlarged details of parts V and W are shown below. A pipe string 30, which may be a part of a production tubing, casing or similar structure, may be formed with a housing 32 for receiving a plug device 10.

In the embodiment shown in FIG. 2, the housing 32 may be an incorporated part of the pipe string 30 and is provided at the connection between an upper and lower pipe 30*a, b* of the pipe string 30. The shearable sleeve 1 is provided in the housing 32 so that the radial protrusions 22 are resting against an abutment surface 34. The abutment surface 34 may be provided as an integrated part of the pipe string 30, but as shown in FIG. 2, the abutment surface 34 may be provided as a separate abutment member, here in the form of a ring, resting on a top, circumferential edge of the lower pipe 30*b* at the connection to the upper pipe 30*a* in the housing 32, as best shown in enlarged detail V. One advantage of providing the abutment surface 34 as a separate insert member 42 (not shown in FIG. 2, see FIG. 7) is that different insert members 42 may be provided for different shearable sleeves 1 of different geometric configurations, without having to make any changes to the housing 32 or pipe string 30, as such.

The disintegrable plug element 8, depicted in FIG. 2 in the form of a glass plug, may rest in the seat 6 of the shearable sleeve 1 via a support ring 36. The support ring 36 may be formed from a relatively soft material, such as PEEK, as discussed above. The support ring 36 may prevent or reduce local shear stresses in the glass plug, thereby reducing the risk of unintended disintegration. A first seal 38 is provided in a first circular recess 39 in inner wall of the upper pipe 30*a*, giving a fluid-tight connection between the disintegrable plug element 8 and the upper pipe 30*a*.

Loading devices 40, shown in FIG. 2 the form of knives, may be connected directly on the inside of the pipe string 30 in a second circular recess 41. The loading devices 40 may further extend and fit complementary into the three, upper recesses 28 in the shearable sleeve 1, as best seen in enlarged view W. A second seal 42 is provided in a recess 43 in the outer wall of the lower pipe 30*b* at the connection between the upper and lower pipes 30*a, b* to create a fluid-tight connection between the upper and lower pipes 30*a, b* in the pipe string 30. The loading devices 40 may be one or more pegs, spikes, knives or similar elements adapted to generate sufficient point loads in the disintegrable plug element 8 to initiate disintegration of the disintegrable plug element 8. In use, the loading device(s) 40 may preferably be connected directly to the inside of the pipe string 30 and fit complementarily into the one or more recesses in the shearable sleeve 1. In an alternative embodiment, the one or more loading devices 40 may be connected directly to the inside of an insert member 42, such as in a separate housing for the disintegrable plug element 8.

In FIG. 2, the plug assembly 100 is shown prior to activation, for example, prior to shearing off the radial protrusions 22 of the shearable sleeve 1 as will be discussed below. In the embodiment shown in FIG. 2, the plug device 10, which may comprise the shearable sleeve 1, the disintegrable plug element 8, the first seal 38 and optionally also the abutment ring 34 and/or the support ring 36, may be provided as a kit of parts that are enabled for assembly by the end user of plug device 10, such as on-site at a topside location of the pipe string.

FIG. 3 shows the plug assembly 100 from FIG. 2 in the same views and with the same enlarged details after activation of the plug assembly 100, for example, after shearing off of the radial protrusions 22 from the shearable sleeve 1. When it is desirable open the plug assembly 100, such as by breaking up the disintegrable plug element 8, the hydraulic pressure may be increased in the pipe string 30 above the disintegrable plug element 8. The hydraulic pressure may exert a downwardly directed force on the disintegrable plug element 8, such that the disintegrable plug element 8 further pushes downwardly on the shearable sleeve 1. The shearable sleeve may be supported in the pipe string 30 by the radial protrusions 22 "hanging" on the abutment ring 34 as best seen in enlarged detail AL.

When the downwardly acting force reaches a pre-defined limit, the radial protrusions 22 may be sheared off from the rest of the shearable sleeve 1, as shown in FIG. 3. As discussed above, the shearable sleeve 1 may be designed and tailored for different activation pressures by the shape, or other design feature, of the radial protrusions and choice of material for the shearable sleeve 1. After activation and shearing, the radial protrusions 22 may remain non-movably supported by the abutment ring 34, while the disintegrable plug element 8 may start moving downwardly in the pipe string 30, together with the seat 6 and the rest of the shearable sleeve 1.

In FIG. 4, the plug assembly 100 is shown corresponding to a stage when the disintegrable plug element 8 has moved downwardly in the pipe string 30 to come into contact with the loading devices 40, as can be best seen in enlarged detail AR. Specifically, the disintegrable plug element 8 may move in an axial direction of the pipe string between a first position in which the disintegrable plug element 8 is spaced apart from the loading devices 40 and a second position in which the disintegrable plug element 8 is in contact with the loading devices 40. At this stage, the disintegrable plug element 8 may have moved a length L downwardly in the pipe string 30, while the radial protrusions 22 may remain "trapped" between the sheared sleeve 1, the inner wall of the pipe string 30 and the abutment ring 34, as best seen in enlarged detail AP.

Figure 5:
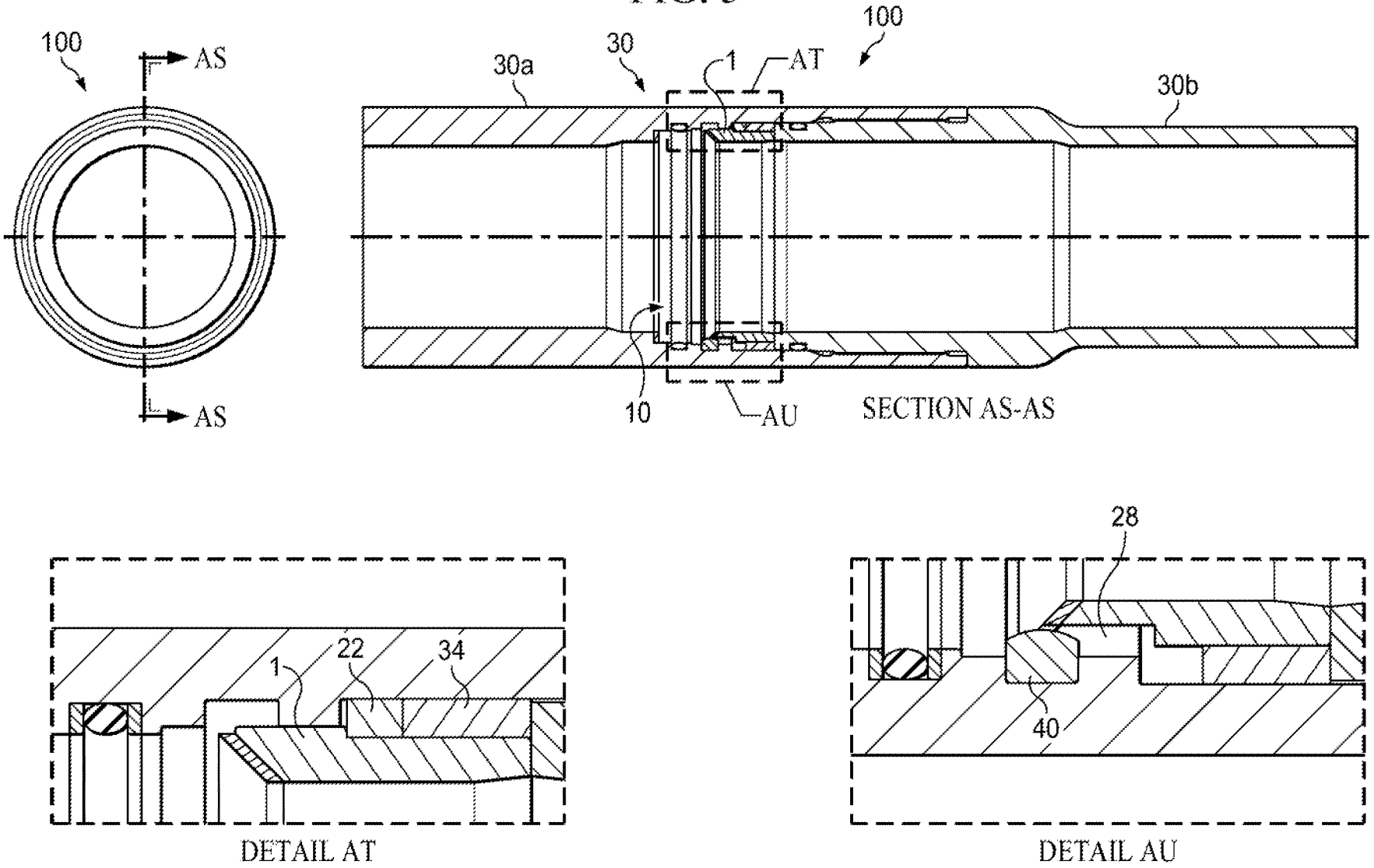
FIG. 5 depicts the first embodiment of the shearable sleeve in a position of use in a plug assembly.

Since the displacement length L from the radial protrusions 22 to the upper circumferential surface 4 may be shorter than the length H (as shown in FIG. 1), as explained above, the radial protrusions 22 may remain "trapped" after disintegration of the disintegrable plug element 8, as shown in FIG. 5, in particular in the enlarged view AT. The first seal 38 may create a fluid-tight fit between the disintegrable plug element 8, both in the initial starting position, as shown in enlarged views V and W in FIG. 2, through the axial downward displacement, as best seen in enlarged views AL and AM in FIG. 3, and until contact has been made with the loading devices 40, best seen in enlarged views AP and AR in FIG. 4. This fluid-tight fit may lead to a more reliable disintegration of the disintegrable plug element 8, since the pressure may be increased further upon contact with the loading devices 40 until the disintegrable plug element 8 has disintegrated.

FIG. 5 shows the remainder of the plug assembly 100 after disintegration of the disintegrable plug element 8. Since the plug housing 32, in the embodiment shown in FIG. 5, is constituted by a slightly expanded inner diameter section of the pipe string 30, the inner diameter is of the pipe string 30 is maintained also across the housing 32 after opening, avoiding restrictions. As shown and evident in FIG. 5, the inner diameter of the shearable sleeve 1 may be substantially equal to the inner diameter of the pipe string 30, except within the housing 32. Since the loading devices 40 may be rigidly connected directly to the inside of the pipe string 30, the loading devices may be ensured to remain fixed to the pipe string 30 and not to fall into the well stream.

Figure 6:
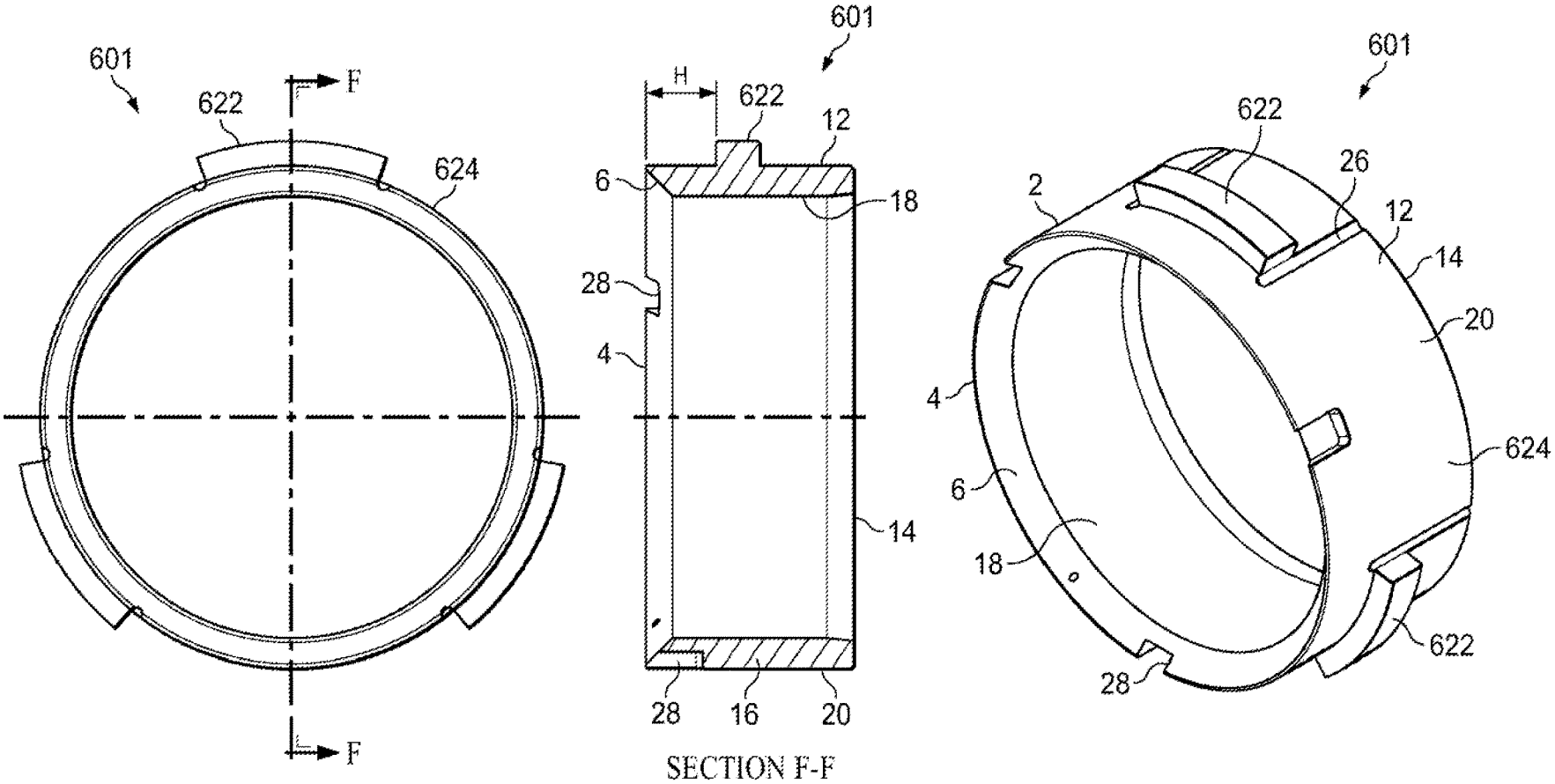
FIG. 6 depicts a second embodiment of a shearable sleeve.

FIG. 6 shows a second embodiment of a shearable sleeve 601. A top view is shown to the left, a cross-sectional axial view F-F in the middle and a perspective view to the right. The shearable sleeve 601 of FIG. 6 has a slightly different geometric configuration than the shearable sleeve 1 of FIG. 1, though the functionality is similar. As shown in FIG. 6, each of the radial protrusions 622 may cover only about 30° of the circumference of the outer portion 20 of the surface 16, while the gap 624 between each protrusion may cover about 90°.

The shearable sleeve 601 shown in FIG. 6 may be particularly adapted to withstand pressures up to 5,000 psi of pressure before activation and shearing, while the shearable sleeve 1 of FIG. 1 may be particularly adapted to withstand 10,000 psi of pressure, as mentioned above. The radial protrusions 22 may be provided substantially half-way between the first circumferential end surface 4 and the second circumferential end surface 14, and may be slightly closer to the upper circumferential end surface 4, as shown in FIG. 6. As shown in both FIGS. 1 and 6, the shearable sleeve 1, 601 may be provided with scratches 26 defining the transition between the radial protrusions 22, 622 and the gaps 24, 624 therebetween. Three recesses 28 adapted to house loading devices 40 are provided at the upper circumferential end surface 4 and may extend about ¼ of the axial length of the shearable sleeve 1 downwardly.

Figure 7:
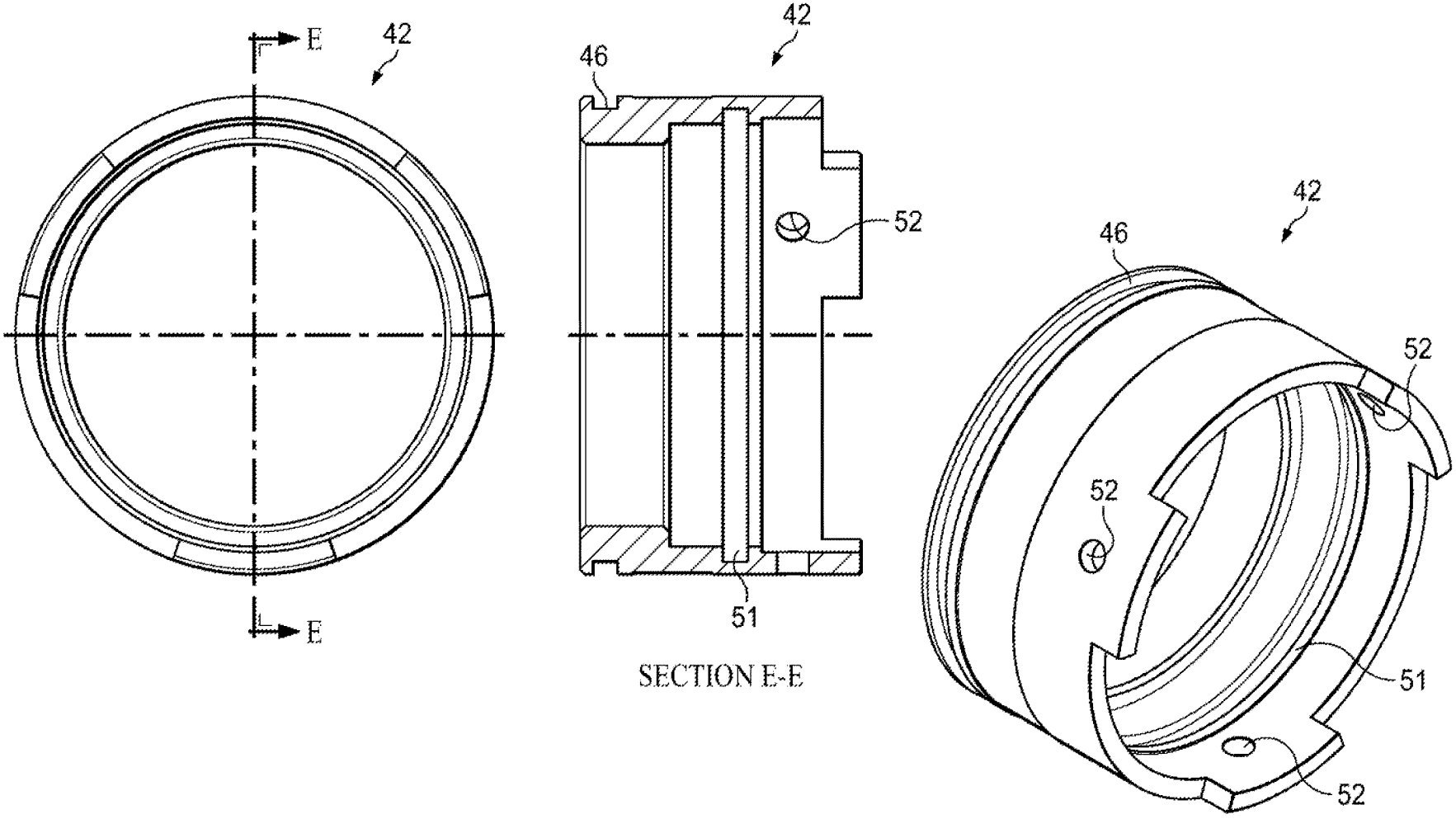
FIG. 7 depicts an insert member as used together with the second embodiment of the shearable sleeve.
Figure 9:
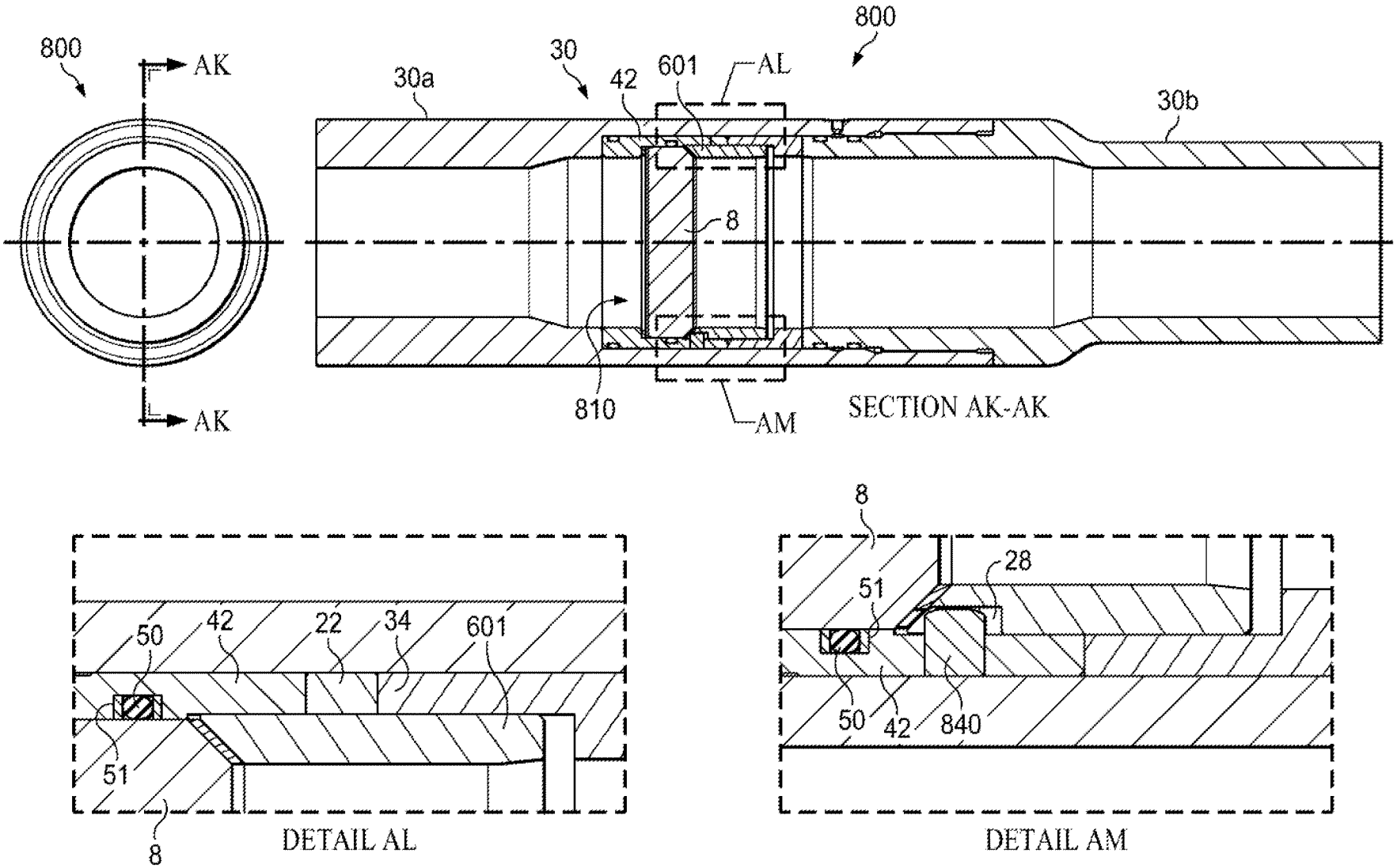
FIG. 9 depicts the second embodiment of the shearable sleeve and the insert member in a position of use in a plug assembly.
Figure 10:
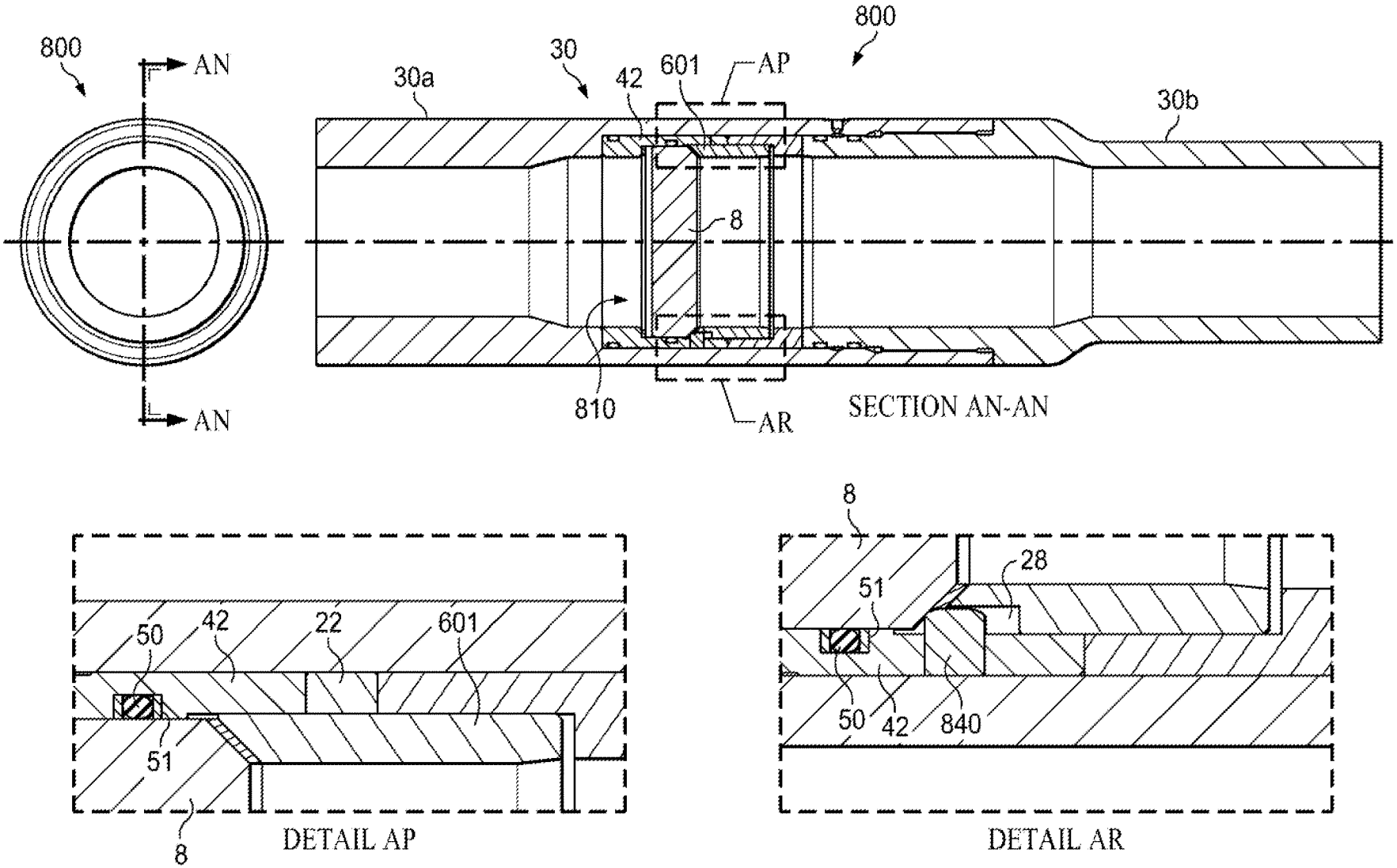
FIG. 10 depicts the second embodiment of the shearable sleeve and the insert member in a position of use in a plug assembly.

FIG. 7 depicts an insert member 42, shown in the form of an insert cylinder, used together with the shearable sleeve 601 of FIG. 6. The insert cylinder 42 may function as a separate housing for the disintegrable plug element 8, and may enable pre-assembly of the disintegrable plug element 8, shearable sleeve 601, loading devices 840 and seal as will be explained below with reference to the following figures. In particular, the insert cylinder 42 may be formed with holes 52 into which the loading devices 840 (not shown in FIG. 7, see FIGS. 8, 9, 10) may be connected. Insert cylinder 42 may be adapted to receive the disintegrable plug element 8, the shearable sleeve 601 and seals, as will be explained below with reference to FIG. 8.

Figure 8:
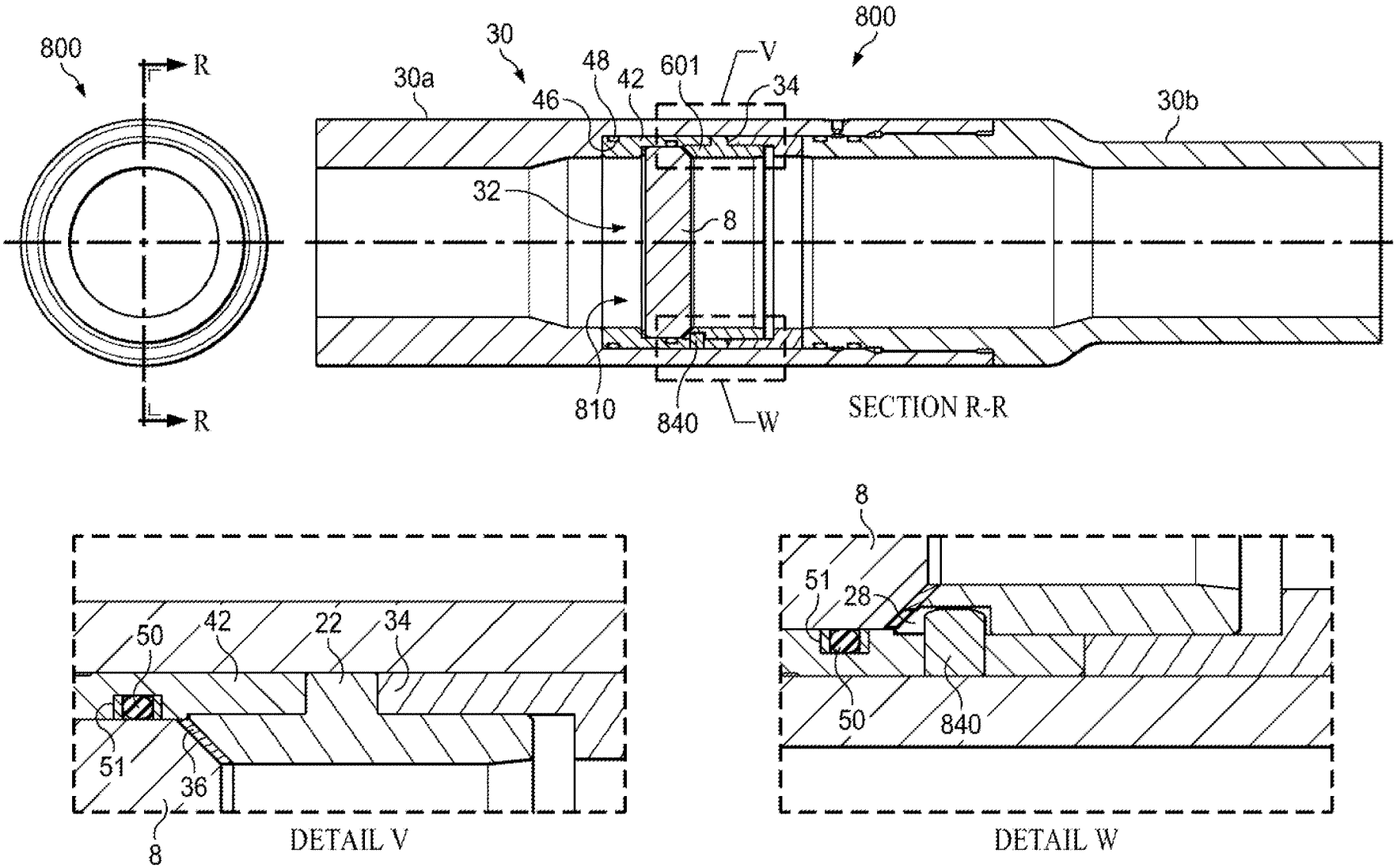
FIG. 8 depicts the second embodiment of the shearable sleeve and the insert member in a position of use in a plug assembly.

In FIG. 8, the shearable sleeve 601 from FIG. 6 and insert cylinder 42 from FIG. 7 are shown as included in a second embodiment of a plug device 810 and plug assembly 800. In particular, the second embodiment in FIG. 8 may differ from the first embodiment shown in FIGS. 2, 3, 4 in that the plug device 810 of the second embodiment includes the insert member 42 functioning as a separate housing for the disintegrable plug element 8.

In the second embodiment shown in FIG. 8, the insert cylinder 42 may have an inner diameter substantially identical to that of the shearable sleeve 601 of FIG. 6 and the pipe string 30 (except from the expanded diameter portion). A seal 50 is shown provided in an inner circular recess 51 of the insert cylinder 42 and may provide a seal between the disintegrable plug element 8 and insert cylinder 42. The shearable sleeve 601 of FIG. 6 may be fitted into the insert cylinder 42 from below after insertion of the seal 50 and the disintegrable plug element 8, such that the radial protrusions are flush with the outer diameter of the insert cylinder 42.

The shearable sleeve 601 of FIG. 6 may connect to the inside of the insert cylinder 42 of FIG. 8 by means of frictional contact. The insert cylinder 42 may be formed with a circular recess 46 in an outer, upper portion for receiving an upper seal 48 for sealing between the insert cylinder 42 and the pipe string 30. In use, the radial protrusions 622 may be supported in the pipe string 30 via abutment member 34, shown in FIG. 8 in the form of an abutment cylinder 34.

As shown in FIG. 8, the plug device 810, including insert cylinder 42, disintegrable plug device 8, shearable sleeve 601 of FIG. 6 and seal 50, may be enabled for pre-assembly, such as a unitary part or an assembly of parts that an end user can obtain. The pre-assembled version of plug device may significantly simplify installation in the pipe string 30 by the end user.

In one embodiment, the plug device 10, 810 may include one or more support rings for supporting the disintegrable plug element 8 in the seat and/or in the pipe string 30. The one or more support rings may be made from a material that is softer than the shearable sleeve 1, 601, and/or the pipe string 30, and may contribute to supporting the disintegrable plug element 8 to prevent local stress and tension and thereby avoid unintentional disintegration of the disintegrable plug element 8. The support ring(s) may comprise PEEK, brass, aluminium, rubber, a plastic material, among other materials, or various combinations thereof.

In one embodiment, the plug device 10, 801 may be as provided as kit of parts. The kit of parts may be useful when the plug device 10, 810 is to be installed directly into the pipe string 30, for example when a part of the pipe string 30 forms a housing for the plug device 10, 810. The plug device 10, 810 may be sold and shipped as a kit of parts and assembled on site. The advantage of having the plug device 10, 810 directly installed in the pipe string 30 is that the direct installation may involve fewer parts, including fewer seals, and may result in fewer potential hydraulic leakage paths being created.

In some embodiments, the plug device 810 may further comprise an insert member 42 for installation of the plug device 810 in a pipe string 30. The insert member 42 may be provided in the form of an insert cylinder or similar into which the at least the shearable sleeve 601 and disintegrable plug element 8 may be pre-assembled. Preferably, the loading devices 840 and one or more seals may also be included with the pre-assembled plug device 810. One advantage of this pre-assembly is that instead of providing the plug device 810 as a kit of loose parts, the main parts of the plug device 810 may be provided as a unitary part or an assembly of parts, which may simplify delivery or installation for the end user.

Figure 11:
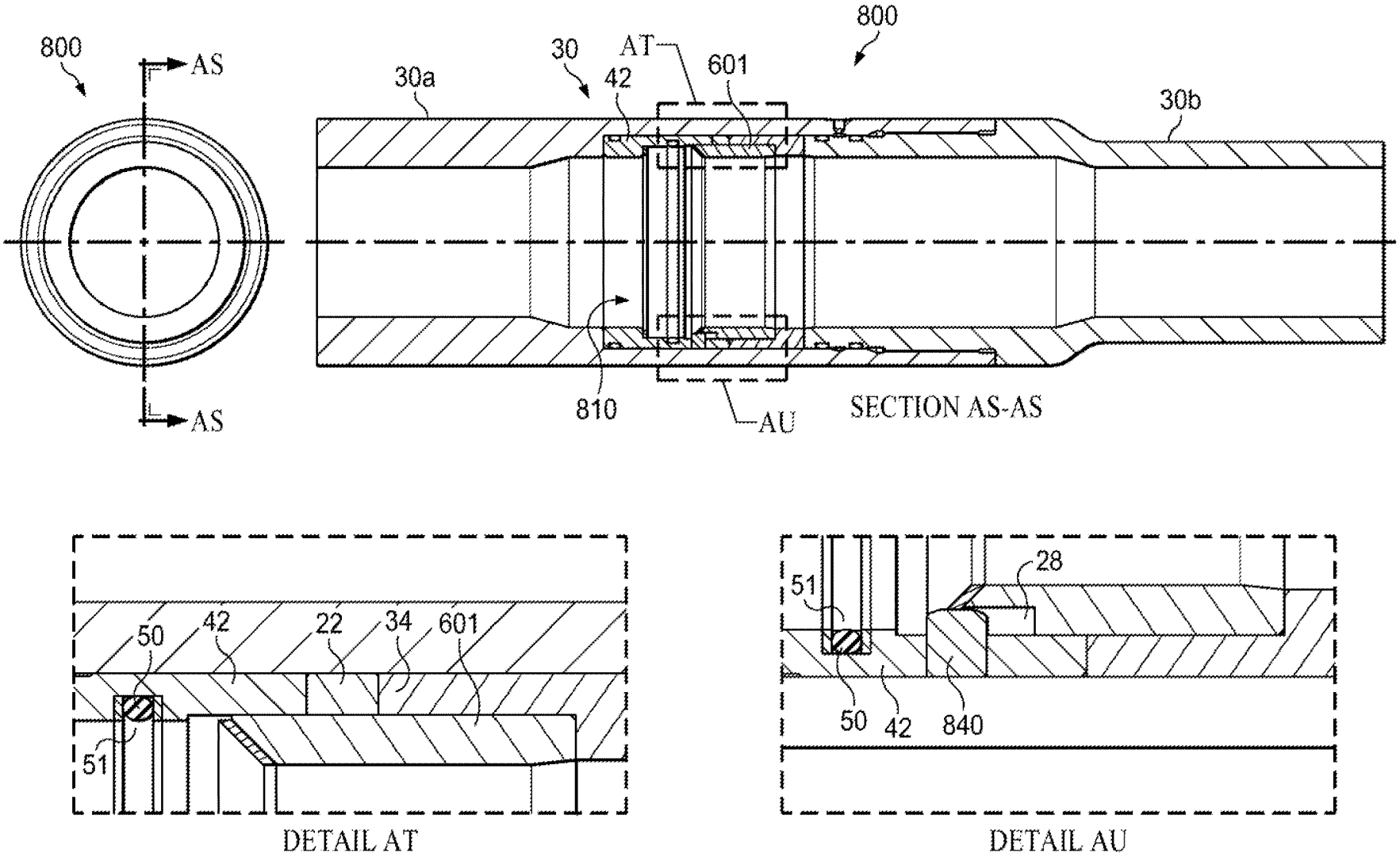
FIG. 11 depicts the second embodiment of the shearable sleeve and the insert member in a position of use in a plug assembly.

When the hydraulic pressure from topside is increased, the downwardly acting force on the disintegrable plug element 8, and thereby also the radial protrusions 22, 622, also increases. In the embodiment shown in FIG. 8, the radial protrusions 622 may be supported by the abutment cylinder 34. When the force exceeds the pre-defined limit (such as corresponding to a pressure of 5,000 psi in one embodiment), the radial protrusions may shear off from the rest of the shearable sleeve 601 of FIG. 6, while the disintegrable plug element 8 and the shearable sleeve 601 may be moved axially downwardly in the pipe string 30 inside the insert cylinder 42 and abutment cylinder 34. The disintegrable plug element 8 may eventually come into contact with the loading device 840 and may disintegrates, as shown in FIG. 11. Both the radial protrusions 22, 622 and the loading devices 40, 840 may remain fixed in the plug assembly 100, 800, therefore, after activation and opening.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

The invention claimed is:

1. A shearable sleeve for supporting a disintegrable plug element in a pipe string, the shearable sleeve comprising:

a first portion including a first circumferential end surface;

a seat for supporting the disintegrable plug element, the seat being included in the first portion of the shearable sleeve;

a second portion including a second circumferential end surface; and a third surface extending axially between the first circumferential end surface and the second circumferential end surface, the third surface further comprising:

a radial protrusion protruding from the third surface and adapted to shear off from the third surface when exposed to a predefined axial force; and at least one recess for receiving a loading device for initiating disintegration of the disintegrable plug element, characterized in that the radial protrusion is axially offset relative to the first circumferential end surface, and further characterized in that the radial protrusion comprises three sub-protrusions that have a first circumferential range and three gaps, each of the three gaps respectively spanning between two adjacent sub-protrusions and having a second circumferential range, wherein a sum of the first circumferential range and the second circumferential range is 120°, and wherein the at least one recess has a third circumferential range that is different from the second circumferential range.

2. The shearable sleeve of claim 1, wherein the radial protrusion is axially offset from the second circumferential end surface.

3. The shearable sleeve of claim 2, wherein the radial protrusion is located half-way between the first circumferential end surface and the second circumferential end surface.

4. The shearable sleeve of claim 1, wherein, in a position of downhole use in a pipe string, the first portion is an upper portion of the shearable sleeve and the second portion is a lower portion of the shearable sleeve.

5. The shearable sleeve according claim 1, wherein the shearable sleeve is enabled for pre-assembly with the disintegrable plug element prior to assembly in the pipe string.

6. The shearable sleeve of claim 1, wherein the first circumferential range defines and is proportional to a surface area of the radial protrusion that is subject to the predefined axial force.

7. The shearable sleeve of claim 1, wherein the radial protrusion protrudes distally spaced apart from the first circumferential end surface and the second circumferential end surface.

8. A plug device for insertion into a pipe string, the plug device comprising:

a shearable sleeve further comprising:

a first portion including a first circumferential end surface;

a seat for supporting a disintegrable plug element, the seat being included in the first portion of the shearable sleeve;

a second portion including a second circumferential end surface; and a third surface extending axially between the first circumferential end surface and the second circumferential end surface, the third surface further comprising:

a radial protrusion protruding from the third surface and adapted to shear off from the third surface when exposed to a predefined axial force; and at least one recess for receiving a loading device for initiating disintegration of the disintegrable plug element, characterized in that the radial protrusion is axially offset relative to the first circumferential end surface;

the disintegrable plug element adapted to be supported by the seat;

the loading device adapted to be received in the recess of the shearable sleeve and adapted to initiate disintegration of the disintegrable plug element upon contact with the disintegrable plug element; and a sealing device for sealing the disintegrable plug element with the pipe string, and further characterized in that the radial protrusion comprises three sub-protrusions that have a first circumferential range and three gaps, each of the three gaps respectively spanning between two adjacent sub-protrusions and having a second circumferential range, wherein a sum of the first circumferential range and the second circumferential range is 120°, and wherein the at least one recess has a third circumferential range that is different from the second circumferential range.

9. The plug device of claim 8, further comprising a support ring for supporting the disintegrable plug element.

10. The plug device of claim 8, further comprising an abutment member adapted to support the radial protrusion against the pipe string.

11. The plug device of claim 8, wherein the shearable sleeve, the disintegrable plug element, and the loading device are enabled for pre-assembly with each other prior to assembly of the plug device in the pipe string.

12. The plug device of claim 8, further comprising an insert member formed as a cylindrical housing for the disintegrable plug element.

13. The plug device of claim 12, wherein the shearable sleeve, the disintegrable plug element, the sealing device and the insert member are enabled for pre-assembly with each other prior to assembly of the plug device in the pipe string.

14. The plug device of claim 8, wherein the first circumferential range defines and is proportional to a surface area of the radial protrusion that is subject to the predefined axial force.

15. The plug device of claim 8, wherein the radial protrusion protrudes distally spaced apart from the first circumferential end surface and the second circumferential end surface.

16. A plug assembly in a pipe string, the plug assembly comprising:

a plug device further comprising:

a shearable sleeve further comprising:

a first portion including a first circumferential end surface;

a seat for supporting a disintegrable plug element, the seat being included in the first portion of the shearable sleeve;

a second portion including a second circumferential end surface; and a third surface extending axially between the first circumferential end surface and the second circumferential end surface, the third surface further comprising:

a radial protrusion protruding from the third surface and adapted to shear off from the third surface when exposed to a predefined axial force; and at least one recess for receiving a loading device for initiating disintegration of the disintegrable plug element, characterized in that the radial protrusion is axially offset relative to the first circumferential end surface;

the disintegrable plug element adapted to be supported by the seat;

the loading device adapted to be received in the recess of the shearable sleeve and adapted to initiate disintegration of the disintegrable plug element upon contact with the disintegrable plug element; and a sealing device for sealing the disintegrable plug element with the pipe string; and a plug housing in which the plug device is located, wherein the disintegrable plug element is movable in an axial direction of the pipe string between a first position in which the disintegrable plug element is spaced apart from the loading device and a second position in which the disintegrable plug element is in contact with the loading device, and further characterized in that the radial protrusion comprises three sub-protrusions that have a first circumferential range and three gaps, each of the three gaps respectively spanning between two adjacent sub-protrusions and having a second circumferential range, wherein a sum of the first radial range and the second radial range is 120°, and wherein the at least one recess has a third circumferential range that is different from the second circumferential range.

17. The plug assembly of claim 16, wherein the first portion of the shearable sleeve is a lower portion, whereby the disintegrable plug element is placed inside the outer surface portion of the shearable sleeve before activation of the plug assembly.

18. The plug assembly of claim 16, wherein the radial protrusion is axially offset from the second circumferential end surface of the shearable sleeve.

19. The plug assembly of claim 18, wherein the radial protrusion is located half-way between the first circumferential end surface and the second circumferential end surface of the shearable sleeve.

20. The plug assembly of claim 16, wherein the plug device further comprises a support ring for supporting the disintegrable plug element.

21. The plug assembly of claim 16, wherein the plug device is axially movable within the plug housing together with the main portion of the shearable sleeve after the radial protrusions have been sheared off.

22. The plug assembly of claim 16, wherein the inner diameter of the shearable sleeve is equal to the inner diameter of the pipe string.

23. The plug assembly of claim 16, wherein the plug device further comprises an abutment member adapted to support the radial protrusion against the pipe string.

24. The plug assembly of claim 16, wherein the radial protrusion of the third surface and the loading device remain fixed in the plug assembly after activation of the plug assembly.

25. The plug assembly of claim 16, wherein the first circumferential range defines and is proportional to a surface area of the radial protrusion that is subject to the predefined axial force.

26. The plug assembly of claim 16, wherein the radial protrusion protrudes distally spaced apart from the first circumferential end surface and the second circumferential end surface.

* * * * *